219-121
4/24/79 XR 4,151,014 SR

United States Patent [19]

Charschan et al.

[11] 4,151,014

[45] Apr. 24, 1979

[54] LASER ANNEALING

[75] Inventors: Sidney S. Charschan, Middletown Township, Bucks County, Pa.; Edward S. Tice, Mercerville, N.J.

[73] Assignee: Western Electric Company, Inc., New York, N.Y.

[21] Appl. No.: 801,666

[22] Filed: May 31, 1977

[51] Int. Cl.[2] ..... C22F 1/00

[52] U.S. Cl. ..... 148/13; 148/32; 148/39; 148/133; 219/121 LM

[58] Field of Search ..... 148/13, 1, 4, 133, 32, 148/39; 219/121 LM

[56] References Cited

U.S. PATENT DOCUMENTS 3,650,846 3/1972 Holland et al. ..... 148/13

*Primary Examiner*—R. Dean

*Attorney, Agent, or Firm*—A. S. Rosen; D. J. Kirk

[57] ABSTRACT

A selected portion of a nonferrous, metallic workpiece, such as a copper or copper alloy workpiece, is annealed to a controlled degree of temper by irradiating the selected portion of the workpiece with a pulsed laser beam, while so regulating a parameter of the pulsed laser beam as to effect the desired, controlled degree of temper. The regulated parameter may be the intensity and/or duration of a laser pulse.

8 Claims, 3 Drawing Figures

FIG. 2
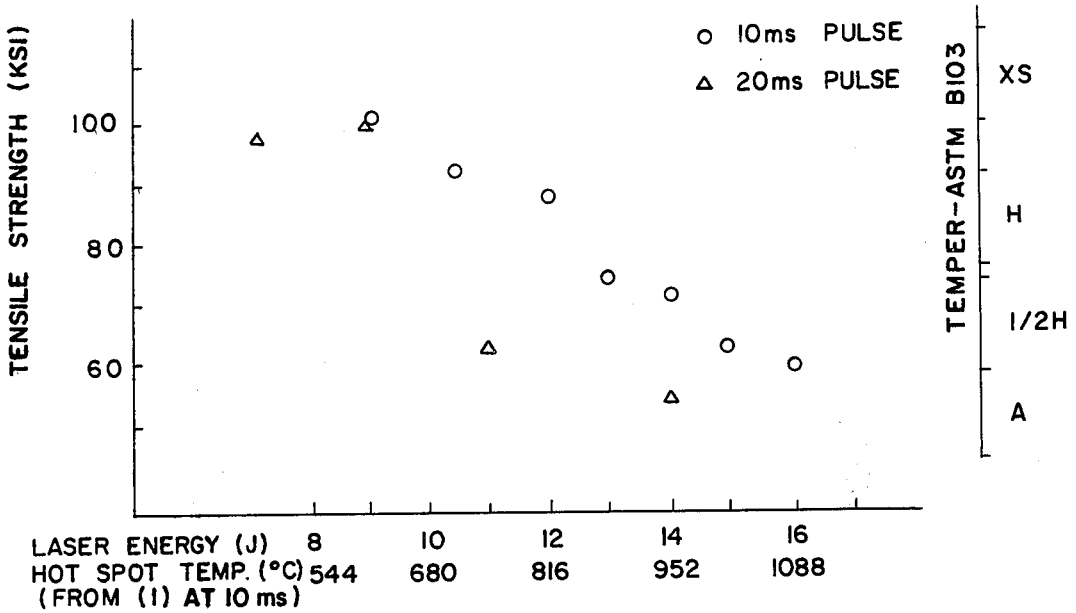
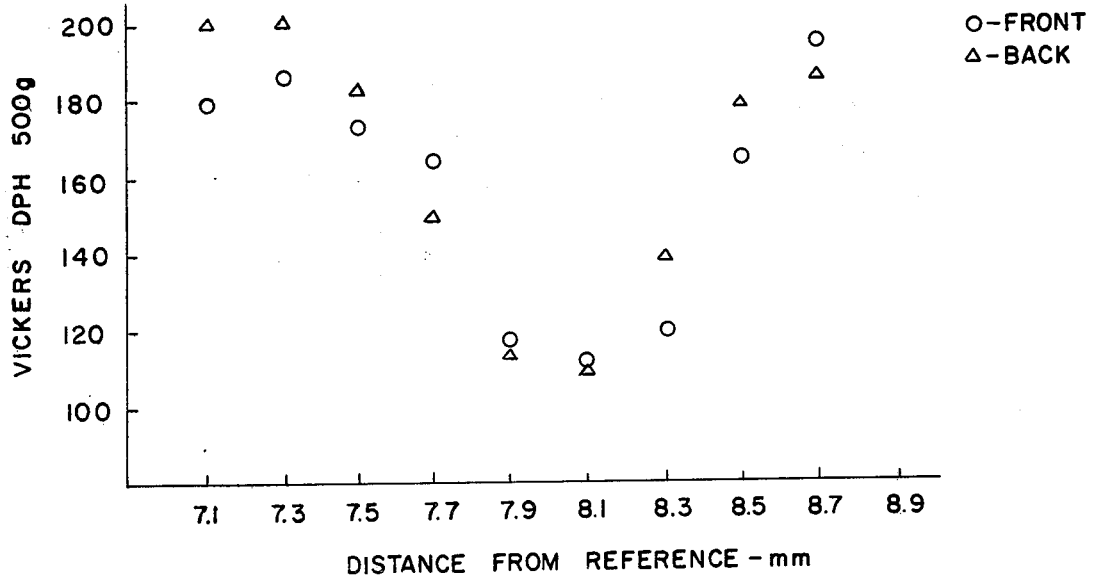
FIG. 3

LASER ANNEALING

BACKGROUND OF THE INVENTION

1. Field of the Invention

The invention relates to techniques for annealing a nonferrous, metallic workpiece and, more particularly, to techniques for annealing a selected portion of a nonferrous, metallic workpiece, utilizing a laser.

2. Description of the Prior Art

It is often necessary that a nonferrous, metallic member have different physical properties in different portions of the member. Phosphor-bronze or beryllium-copper connector contact springs, for example, must be hardened to spring or extra-spring hardness in order to perform their basic function, i.e., the making and maintaining of good electrical connections. Such spring members must often, however, be joined to circuit paths on a brittle substrate, e.g., by thermocompression bonding. In order that thermocompression bonding may take place, the metal in the bonding area of a spring member which is to be bonded to a circuit path must be relatively soft so that the bond can be effected without cracking the brittle substrate.

At present, dual metal connector contact springs are employed to provide the different physical properties required for good electrical contacting and good thermocompression bonding capabilities. Thus, composite metal rolling operations may provide beryllium-copper alloy and copper spring members, the beryllium-copper alloy component being hardened to the necessary degree for the spring members to function properly, and the copper component being sufficiently soft to permit thermocompression bonding of the spring members to the circuit paths. Such composite spring members, while effective to provide the required properties, are quite costly to manufacture.

A technique for treating a single component, nonferrous, hard spring member, in order to soften the material of the spring member in only a small, locallized bonding area, might involve the annealing of the spring member at only the bonding area. Utilizing a furnace, for example, complex masking fixtures might be employed to shield the spring in other than the bonding area. However, for nonferrous metals at spring or extra-spring hardness, the transition from the hard to the fully annealed state is so rapid that it is not possible to obtain consistently a required intermediate value of hardness in mass production. The presence of a fully annealed region on a spring member is considered disadvantageous since, for example, the spring member would be subject to distortion in handling.

It is known to employ a continuous wave laser to heat soften a metallic workpiece. The continuous wave laser, heat softening technique, however, requires the continuous application of a relatively low level of power to the workpiece for a relatively long period of time. Thus, lateral conduction of heat within the workpiece during treatment with a continuous wave laser makes controlled, localized heating of only a selected portion of the workpiece virtually impossible.

It is also known to shock harden a selected surface area of a metallic workpiece, which may be a ferrous workpiece, by employing a pulsed laser. Such localized shock heating by a pulsed laser typically requires the application of very high energy density levels to the selected surface area, typically, through a surface coating or overlay.

SUMMARY OF THE INVENTION

The invention contemplates a technique for annealing a selected portion of a nonferrous, metallic workpiece to a controlled degree of temper. The selected portion is treated by irradiation with a pulsed laser beam, while a parameter of the beam, such as intensity and/or pulse duration, is so regulated as to effect the controlled degree of temper. By employing a pulsed laser, power may be applied effectively to the selected portion of the workpiece in such manner as to bring such selected portion rapidly to an annealing temperature. As a result, the annealing of the selected portion may take place in a controlled manner, with negligible lateral conduction of heat energy into portions of the workpiece other than the selected portion. Moreover, the technique requires no complex masking fixtures, tools, coatings or overlays.

The workpiece may be formed of copper or a copper alloy, although other nonferrous metals might also be utilized. By annealing only the localized, selected portion of the workpiece in a controlled manner, thermocompression bonding may thereafter take place at the selected portion. Alternatively, other operations which are enhanced by the presence of a localized, annealed region on a nonferrous, metallic workpiece, e.g., bending of the workpiece, may be performed after the irradiation of the selected region with the pulsed laser beam.

DESCRIPTION OF THE DRAWING

FIG. 2 is a plot of tensile strength and temper versus energy and hot spot temperature for a typical sample workpiece annealed in accordance with the principles of the invention; and FIG. 3 is a plot of hardness versus location along the workpiece for the sample of FIG. 2.

DETAILED DESCRIPTION

Figure 1:
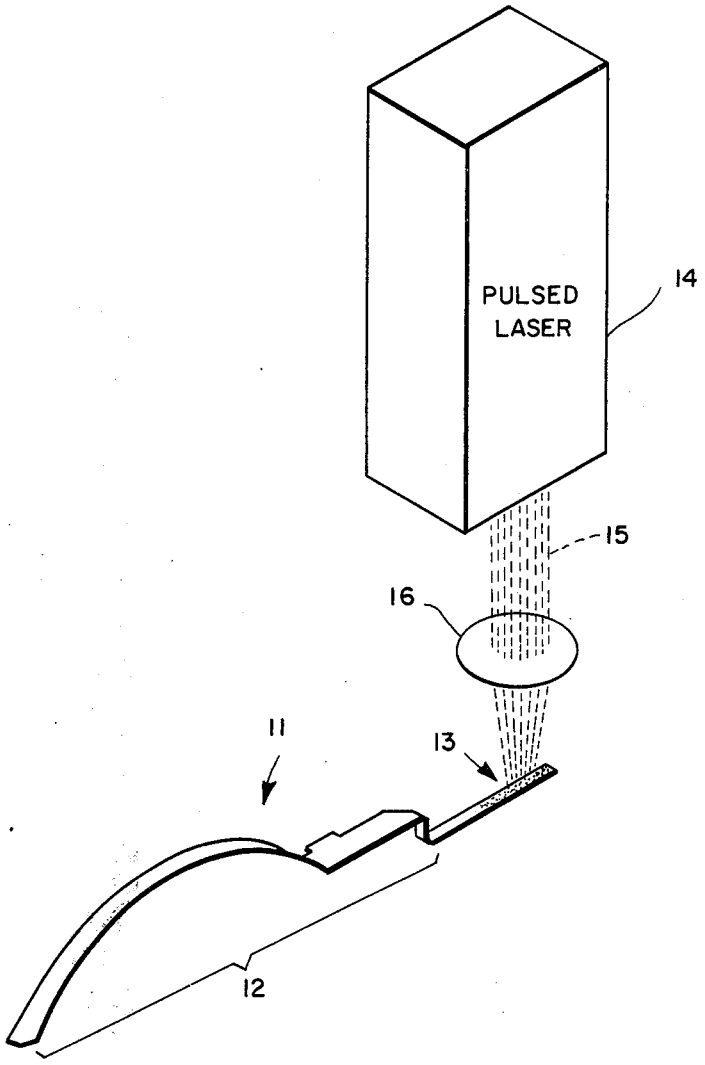
FIG. 1 of the drawing is a partially schematic, isometric illustration of apparatus which may be employed in annealing a selected portion of a nonferrous, metallic workpiece to a controlled degree of temper in accordance with the principles of the invention.

Referring to the drawing, it is desired that a spring member 11, which may be composed of any suitable nonferrous, metallic material, e.g., phosphor-bronze or beryllium-copper, be hardened to a considerable degree along a major portion 12 of its length, e.g., to spring or extra-spring temper. Such hardness is required for the spring to perform its intended function, i.e., the making and maintaining of good electrical connections. It is also desired that the spring member 11 be softened along a small, localized, selected portion 13 where the spring member 11 is to undergo thermocompression bonding to a circuit path on a brittle substrate.

A pulsed laser 14, e.g., a pulsed Nd:YAG laser, is utilized to irradiate the selected portion 13 of the spring member 11 in order to soften the selected portion 13 by annealing. The pulsed laser 14 is capable of emitting a laser beam 15 at a controlled energy level, e.g., 8 to 16 Joules (J), at a constant spot size, e.g., a 0.7 millimeter (mm) diameter, for a controlled duration, e.g., 10 or 20 milliseconds (ms). The laser beam 15 is focussed onto the selected portion 13 of the spring member 11 by a lens 16.

It is desired that the annealing operation be sufficiently localized to affect only the selected portion 13 of the spring member 11, while providing a controlled degree of temper in the selected portion 13. Use of the pulsed laser 14 enables the annealing operation to be performed in the desired localized, controlled manner.

Control of the degree of temper in the selected portion 13 of the spring member 11 is accomplished by regulating a parameter of the laser beam 15 in suitable manner. Such parameter of the laser beam 15 may, for example, be either the intensity or the pulse duration of the beam 15, or may be a combination of both such factors. Alternatively, the parameter may, for example, constitute the number of pulses of the beam 15 with which the selected portion 13 is irradiated. A single pulse annealing operation, involving a relatively long pulse duration, e.g., at least 5 ms, is considered suitable, however, for most applications.

In the course of investigating the use of pulsed lasers, such as the laser 14, to anneal selected portions of nonferrous, metallic members, such as the selected portion 13 of spring member 11, to a controlled degree of temper, a number of tests have been conducted. Such tests are discussed in the following Example:

EXAMPLE

The spring members 11 used in the tests were stamped from CDA-510 phosphor-bronze, extra spring temper, strip stock. The nominal composition of CDA-510 phosphor-bronze is 94.8 percent copper, 5.0 percent tin and 0.2 percent phosphorus. Each sample spring member 11 included a selected portion 13, adapted for thermocompression bonding of the spring member 11 to a circuit path on a substrate, with the selected portion 13 being 0.7 mm wide and 2.54 mm long, and with the spring member 11 being 0.2 mm thick.

A Raytheon Model SS-480 pulsed, line-driven Nd:YAG laser 14 was used, and was operated at a wavelength of 1.06 $\mu$m. In irradiating the spring member samples, five 10 ms duration pulses were fired at a 4 pulse per second rate. The first four pulses were deflected away from each sample, and were used only to attain thermal stability of the laser. The last pulse irradiated the sample. Although an initial peak often enhances some drilling and welding processes, it is not considered desirable to use the initial peak in heat treating, since a more uniform temperature rise is preferred.

The samples received no special preparation for the laser experiments, but care was taken to minimize the introduction of "new" contaminants on the surface of each sample, beyond those that might be present due to the standard manufacture of the spring member 11. The effective laser spot diameter was maintained at 0.7 mm, so as to cover the width of the sample. All of the samples were irradiated under these conditions.

Four samples were irradiated at each of several energy levels, employing a constant 10 ms pulse length. The maximum intensity was established by increasing the output energy level until melting was observed at above 16J. Other samples were made at conveniently spaced energies from 16J down to a minimum level studied of 8J.

Samples were also irradiated on a different pulsed, line-driven Nd:YAG laser 14, specially modified to deliver 20 ms duration pulses. Melting took place at about 16J for this laser as well.

The resultant temper was determined by measuring the tensile strength in accordance with ASTM B103. The results are summarized in FIG. 2 of the drawing. Tensile tests were done on an Instron Model TM testing apparatus. Crosshead speed was one inch per minute.

Vickers DPH (500 g load) hardness was measured every 0.2 mm along a line 0.2 mm from the edge of each sample. Because of the thinness of the material, and since further sample evaluation precluded mounting, the hardness values, which are shown in FIG. 3 of the drawing, are relative values. Such relative values show clearly the extent of the heat affected zone.

The hardness across the irradiated zone on both the irradiated and reverse sides is shown in FIG. 3 for a typical sample. Note that on the irradiated (front) side the heat-affected zone is only 1.4 mm wide with an effective spot size of 0.7 mm.

A metallographic analysis was made of the same sample for which the hardness values are shown in FIG. 3. The heat affected zone did not show the effects of recrystallization or grain growth usually associated with annealing. This is an unexpected result and is not fully understood at this time. It is speculated that the softening mechanism is due to recovery of strain induced during a rolling operation by means of which the spring member 11 was initially formed.

T. P. Lin, in an article in the September 1967 issue of the *IBM Journal*, entitled, "Estimation of Temperature Rise in Electron Beam Heating of Thin Films", obtained a solution for a beam with a gaussian intensity distribution heating a slab of finite thickness. Lin showed that the temperature at the center of the spot is:

$$v(o,t)=H_o\, a^2/4KL\ ln(l+4Kt/a^2) \qquad (1)$$

where, $v(o,t)$=Temperature rise in ° C;
$H_o$=Peak Flux;
a=Spot Radius;
K=Thermal Conductivity;
L=Slab Thickness;
K=Thermal Diffusivity; and
t=Pulse Duration.

This model was supported by the experimental results at 17 J and 10 ms where melting was observed as the model predicted. Predicted temperatures for lower incident fluxes could not be measured but are considered to be reasonably accurate in light of the verification of the melting point.

The temperatures from Equation (1) for various laser energy levels and 10 ms pulse duration are plotted in FIG. 2. It is clear from viewing FIG. 2 that some annealing occurs in a very short time at relatively low temperatures, and that the CDA-510 phosphor-bronze material can be fully annealed in about 10 ms.

This Example is considered to illustrate clearly that the degree of temper (FIG. 2) at a relatively localized, selected portion 13 (FIG. 3) of the spring member 11 may be relatively precisely controlled by regulation of a suitable parameter, e.g., intensity and/or pulse duration, of a pulsed laser. For example, by adjusting the energy output of the laser between 8 and 16 J, the selected portion 13 can be annealed to any temper in the range from soft to the original extra-spring temper.

The heat-affected zone in this Example is quite small, i.e., 1.4 mm. Larger areas, of course, may be annealed by conventional spot shaping techniques and/or by an overlapping of pulses.

It is to be understood that the described technique, apparatus and Example are simply illustrative of preferred embodiments of the invention. Many modifications may, of course, be made in accordance with the principles of the invention.

What is claimed is:

1. A method of annealing a selected portion of a hardened nonferrous, metallic workpiece to a controlled degree of intermediate temper, comprising the steps of:

(a) irradiating the selected portion of the hardened nonferrous, metallic workpiece with a pulsed laser beam; while (b) so regulating a parameter of the pulsed laser beam as to effect said controlled degree of intermediate temper.

2. A method as set forth in claim 1, wherein step (b) comprises:

(c) regulating at least one of the intensity and pulse length of the laser beam.

3. A method as set forth in claim 1, wherein step (b) comprises:

(c) regulating the intensity of the pulsed laser beam.

4. A method as set forth in claim 1, wherein step (b) comprises:

(c) regulating the pulse length of the laser beam.

5. A method as set forth in claim 1, wherein step (b) comprises:

(c) regulating both the intensity and the pulse length of the laser beam.

6. A method as set forth in claim 1, wherein step (a) comprises:

(c) irradiating the selected portion of the nonferrous, metallic workpiece with a single pulse of laser energy.

7. A method as set forth in claim 6, wherein step (c) further comprises:

(d) irradiating the selected portion of the nonferrous, metallic workpiece with a pulse of at least five millisecond duration.

8. A method as set forth in claim 6, further comprising the preliminary steps of:

(d) pulsing the laser beam at least once prior to the performance of step (c); while (e) directing the laser beam away from the nonferrous, metallic workpiece for each pulse of the laser during step (d).

* * * * *

UNITED STATES PATENT OFFICE

CERTIFICATE OF CORRECTION

PATENT NO. : 4,151,014

DATED : April 24, 1979

INVENTOR(S) : S. S. Charschan and E. S. Tice

It is certified that error appears in the above-identified patent and that said Letters Patent are hereby corrected as shown below:

Column 2, lines 36-37, "versus energy" should read --versus laser energy--. Column 4, line 29, equation (1), that portion of the equation reading $(1 + 4Kt/a^2)$ should read $(1 + 4\kappa t/a^2)$ Column 4, line 37, "K = Thermal Diffusivity; and" should read -- $\kappa$ = Thermal Diffusivity; and--.

Signed and Sealed this

*Seventeenth* . Day of *July 1979*

[SEAL]

*Attest:*

*Attesting Officer*

LUTRELLE F. PARKER

*Acting Commissioner of Patents and Trademarks*